US007448586B2

(12) United States Patent
Ziaylek et al.

(10) Patent No.: US 7,448,586 B2
(45) Date of Patent: Nov. 11, 2008

(54) POSITIVELY ENGAGING APPARATUS FOR RELEASABLY RETAINING OF A CYLINDRICAL TANK IN AN INVERTED VERTICAL POSITION

(76) Inventors: Michael P. Ziaylek, 15 Cold Spring Ave., Yardley, PA (US) 19067; Theodore P. Ziaylek, 152 Riverview Ave., Yardley, PA (US) 19067

( * ) Notice: Subject to any disclaimer, the term of this patent is extended or adjusted under 35 U.S.C. 154(b) by 0 days.

(21) Appl. No.: 11/732,998

(22) Filed: Apr. 5, 2007

(65) Prior Publication Data

US 2008/0245942 A1 Oct. 9, 2008

(51) Int. Cl.
*A47K 1/08* (2006.01)

(52) U.S. Cl. ..... 248/311.3; 248/313

(58) Field of Classification Search ..... 248/311.3, 248/310, 154, 313, 316.1; 224/403, 497, 224/633; 410/46, 42; 211/75
See application file for complete search history.

(56) References Cited

U.S. PATENT DOCUMENTS

| | | | |
|---|---|---|---|
| 1,286,998 | A | 12/1918 | Graaff |
| 2,029,051 | A | 1/1936 | Blevins |
| 2,278,232 | A | 3/1942 | Anderson |
| 2,289,701 | A | 7/1942 | Engel et al. |
| 2,404,513 | A | 7/1946 | McCabe |
| 2,431,698 | A | 12/1947 | Lombard |
| 2,615,238 | A | 10/1952 | Highwood |
| D188,000 | S | 5/1960 | Shanok et al. |
| 3,224,644 | A | 12/1965 | Davis |
| 3,490,727 | A | 1/1970 | Miller |
| 3,547,391 | A | 12/1970 | Johnson |
| 3,565,384 | A | 2/1971 | Lockwood |
| 3,603,550 | A | 9/1971 | Byrd |
| D222,527 | S | 11/1971 | Ziaylek, Jr. |
| 3,667,714 | A | 6/1972 | Ziaylek, Jr. |
| 3,737,133 | A | 6/1973 | Boecker |
| 3,765,635 | A | 10/1973 | Burrell et al. |
| 3,765,636 | A | 10/1973 | Burrell et al. |
| 3,780,972 | A | 12/1973 | Brodersen |
| 3,823,907 | A | 7/1974 | Ziaylek, Jr. |
| D237,357 | S | 10/1975 | Ziaylek, Jr. |
| 3,971,591 | A | 7/1976 | Ziaylek |
| 4,023,761 | A | 5/1977 | Molis |
| D245,929 | S | 9/1977 | Montambo |
| 4,175,666 | A | 11/1979 | Smith |
| 4,213,592 | A | 7/1980 | Lingenfelser |
| D267,227 | S | 12/1982 | Ziaylek, Jr. |
| 4,391,377 | A | 7/1983 | Ziaylek, Jr. |
| D275,264 | S | 8/1984 | Wegener, II |
| 4,505,448 | A | 3/1985 | Massie |
| 4,586,687 | A | 5/1986 | Ziaylek, Jr. |

(Continued)

*Primary Examiner*—Ramon O Ramirez
(74) *Attorney, Agent, or Firm*—Sperry, Zoda & Kane

(57) ABSTRACT

A mechanical bracket for positively engaging of a generally cylindrical tank such as an SCBA tank in an inverted position mounted to a planar surface such as within the back of a fire truck seat. The apparatus includes a uniquely configured top clamping member which is pivotally mounted to selectively engage the upwardly facing bottom of the tank as well as including a bumper immediately thereadjacent which is adjustably positionable for abutment with the lower end of the tank which is facing upwardly. A uniquely configured foot plate is provided having a tank receiving zone defined therewithin for holding of the upper valving area of such tanks. A unique locking mechanism and release mechanism is also provided.

31 Claims, 7 Drawing Sheets

U.S. PATENT DOCUMENTS

| | | | |
|---|---|---|---|
| 4,606,521 | A | 8/1986 | Williams |
| 4,624,432 | A | 11/1986 | Salacuse |
| D298,704 | S | 11/1988 | Ziaylek, Jr. |
| 4,848,714 | A | 7/1989 | Ziaylek, Jr. et al. |
| D303,738 | S | 10/1989 | Ziaylek, Jr. |
| 4,905,950 | A | 3/1990 | Turner et al. |
| D314,325 | S | 2/1991 | Ziaylek, Jr. et al. |
| 5,025,935 | A | 6/1991 | Hadachek |
| D319,778 | S | 9/1991 | Ziaylek, Jr. |
| 5,297,890 | A | 3/1994 | Commins |
| D347,735 | S | 6/1994 | Ziaylek, Jr. et al. |
| 5,318,266 | A | 6/1994 | Liu |
| 5,354,029 | A | 10/1994 | Ziaylek, Jr. et al. |
| 5,423,508 | A | 6/1995 | Isenga et al. |
| 5,440,098 | A | 8/1995 | Matus |
| 5,533,701 | A | 7/1996 | Trank |
| 5,579,967 | A | 12/1996 | Berg |
| 5,607,133 | A | 3/1997 | Markham et al. |
| 5,681,080 | A | 10/1997 | Pond et al. |
| D394,381 | S | 5/1998 | Ziaylek, Jr. et al. |
| 5,833,195 | A | 11/1998 | Haynes |
| 5,890,544 | A | 4/1999 | Love et al. |
| 5,906,302 | A | 5/1999 | Spergel |
| 5,975,475 | A | 11/1999 | Chaplin |
| D424,414 | S | 5/2000 | Ziaylek et al. |
| 6,113,004 | A | 9/2000 | Steingass et al. |
| 6,138,768 | A | 10/2000 | Fujiki |
| D434,495 | S | 11/2000 | Whalen et al. |
| 6,168,130 | B1 | 1/2001 | Yokogi |
| 6,220,557 | B1 | 4/2001 | Ziaylek et al. |
| D480,294 | S | 10/2003 | Ziaylek, Jr. et al. |
| 6,655,745 | B2 | 12/2003 | Fohrenkamm et al. |
| 6,685,153 | B2 | 2/2004 | Foreman |
| 6,702,242 | B1 | 3/2004 | Ziaylek, Jr. et al. |
| D494,049 | S | 8/2004 | Ziaylek et al. |
| D494,453 | S | 8/2004 | Ziaylek et al. |
| 6,769,659 | B1 | 8/2004 | Martello |
| 6,779,770 | B2 | 8/2004 | Kaupp |
| 6,830,226 | B2 | 12/2004 | Field et al. |
| 6,863,198 | B1 | 3/2005 | Darby |
| 6,883,766 | B1 | 4/2005 | Ziaylek et al. |
| 6,889,947 | B2 | 5/2005 | Alberts |
| 6,926,243 | B1 | 8/2005 | Ziaylek et al. |
| 6,951,328 | B1 | 10/2005 | Drapeau et al. |
| 7,028,962 | B1 | 4/2006 | Hostetler |
| 7,063,298 | B2 | 6/2006 | Henry |
| 7,070,372 | B2 | 7/2006 | Denike et al. |

POSITIVELY ENGAGING APPARATUS FOR RELEASABLY RETAINING OF A CYLINDRICAL TANK IN AN INVERTED VERTICAL POSITION

BACKGROUND OF THE INVENTION

1. Field of the Invention

Generally the present invention relates to brackets or other holding or support surfaces preferably capable of detachably securing a cylindrical tank or cylinder similar to the SCBA tanks carried on the back of firefighters or other emergency personnel. Such devices are widely used by emergency workers and are normally held in a vertical position at various locations usually in the vertical seat backs of rescue vehicles. The present invention provides a unique apparatus which positively engages the tank mechanically by gripping the upper and lower ends and retaining of the tank in an inverted vertically extending position. Such devices require extremely reliable clamping mechanisms due to the fact that the tanks will normally be secured to personnel while seated within a fire truck or other emergency vehicle during various aspects of travel. Also a quick and easy method of securement is required as well as an extremely speedy and reliable release mechanism. Also such SCBA tanks often vary significantly in size both in length and diameter and for this reason the present invention needs particularly to be adaptable and adjustable to facilitate use with various configurations of tanks and associated attached apparatus. It is also preferable that adjustments to the bracket required for the various configurations of tanks and tank apparatus need to be completely accessible from the front side of the bracket. The present invention provides such an apparatus. Also it is important that the means of gripping of the tank be secure and yet be capable of custom adjustment because many of these cylinders are made by wrapping of epoxy resin material around a metallic shell. This material is more susceptible to damage than conventional metallic tanks.

2. Description of the Prior Art

Many patents have been granted on mechanical brackets for use in holding cylindrical tanks such as SCBA air tanks having various configurations which are designed specifically to allow detachable securement of the tanks to vertical surfaces such as within the rear seat back of seats in an emergency vehicle such as a fire truck. Several of the most relevant prior art to this subject matter are shown in U.S. Pat. No. 1,286,998 patented Dec. 10, 1918 to C. Graaff on a "Fire Extinguishing Arrangement For Aerial Craft"; and U.S. Pat. No. 2,029,051 patented Jan. 28, 1936 to A. C. Blevins and assigned to Nu-Deal Handle Co. on a "Bottle Holder"; and U.S. Pat. No. 2,278,232 patented Mar. 31, 1942 to P. A. Anderson and assigned to Utilities Distributors, Inc. on a "Gas Installation Housing"; and U.S. Pat. No. 2,289,701 patented Jul. 14, 1942 to H. R. Engel et al on a "Bottle Holder"; and U.S. Pat. No. 2,431,698 patented to H. Lombard on a "Removable Mounting Installation"; and U.S. Pat. No. 2,404,513 patented Jul. 23, 1946 to B. L. McCabe and assigned to Stuart Oxygen Co. on a "Gas Cylinder Holder"; and U.S. Pat. No. 2,458,810 patented Jan. 11, 1949 to K. W. Varney et al; and U.S. Pat. No. 2,492,841 patented Dec. 27, 1949 to C. E. Burkey on a "Pivoted Counterbalanced Car Top Carrier"; and U.S. Pat. No. 2,525,226 patented Oct. 10, 1950 to W. D. Lawellin on a "Combination Siding, Wrecking, And Nail Extracting Tool"; and U.S. Pat. No. 2,533,771 patented Dec. 12, 1950 to J. H. DeFrees and assigned to Pennsylvania Furnace and Iron Company on a "Vented Closure For Milk Tank Manholes"; and U.S. Pat. No. 2,586,531 patented to D. L. Gordon on Feb. 19, 1952 on a "Wheeled Support Having Ladder Assembly"; and U.S. Pat. No. 2,615,238 patented Oct. 28, 1952 to W. Highwood on a "Tank Clamp Support Holder"; and U.S. Pat. No. 3,224,644 patented Dec. 21, 1965 to W. J. Davis on a "Dispenser"; and U.S. Pat. No. 3,490,727 patented Jan. 20, 1970 to H. Q. Miller on a "Holding Apparatus For Loads Adapted Top Be Strapped To The Back Of Humans"; and U.S. Pat. No. 3,547,391 patented Dec. 15, 1970 to D. E. Johnson on a "Quick Release Support For Rescue Breathing Apparatus"; and U.S. Pat. No. 3,565,384 patented Feb. 23, 1971 to L. A. Lockwood and assigned to Bernzomatic Corporation on a "Bracket For Holding And Clamping Gas Cylinder Type Fire Extinguisher Tanks"; and U.S. Pat. No. 3,602,368 patented Aug. 31, 1971 to R. H. Gould and assigned to Sun Oil Company on a "Pallet For Gas Cylinders And The Like"; and U.S. Pat. No. 3,603,550 patented Sep. 7, 1971 to C. D. Byrd and assigned to Lacy J. Miller Machine Company, Inc. on a "Quick Release Support"; and U.S. Pat. No. 3,667,714 patented Jun. 6, 1972 to T. Ziaylek, Jr. on a "Tank Support"; and U.S. Pat. No. 3,737,133 patented Jun. 5, 1973 to A. J. Boecker and assigned to Akron Brass Company on a "Quick-Release Article Holder"; and U.S. Pat. No. 3,765,635 patented Oct. 16, 1973 to W. R. Burrell et al and assigned to Burrell Bros., Inc. on a "Bracket For Gas Containers And Similar Tanks"; and U.S. Pat. No. 3,765,636 patented Oct. 16, 1973 to W. R. Burrell et al and assigned to Burrell Bros., Inc. on a "Vise For Gas Containers And Similar Tanks"; and U.S. Pat. No. 3,780,972 patented Dec. 25, 1973 to J. C. Bordersen on a "Mounting Apparatus For Gas Containers"; and U.S. Pat. No. 3,823,907 patented Jul. 16, 1974 to T. Ziaylek, Jr. on a "Positive Locking Device"; and U.S. Pat. No. 3,971,591 patented Jul. 27, 1976 to J. Ziaylek and assigned to Ziamatic Corporation on a "Quic-Seat"; and U.S. Pat. No. 4,023,761 patented May 17, 1977 to J. Molis on an "Adjustable Bracket To Stabilize Upright Compressed Gas Containers Against Displacement On Mobile Vehicles And Ship-Board Installation And Maintenance Shops"; and U.S. Pat. No. 4,175,666 patented Nov. 27, 1979 to R. G. Smith and assigned to Kleen-Rite, Inc. on "Tank Support Assemblies"; U.S. Pat. No. 4,213,592 patented Jul. 22, 1980 to D. J. Lingenfeiser and assigned to Caterpillar Tractor Co. on a "Bracket Assembly For Mounting Fire Extinguishers Thereon"; and U.S. Pat. No. 4,391,377 patented Jul. 5, 1983 to T. Ziaylek, Jr. on a "Knock-Down Assembly For Supporting Oxygen Tanks"; and U.S. Pat. No. 4,505,448 patented Mar. 19, 1985 to C. P. Massie on a "Bracket For Fire Extinguishers"; and U.S. Pat. No. 4,586,687 patented May 6, 1986 to T. Ziaylek, Jr. on an "Air Tank Support Of The Quick Release Type"; and U.S. Pat. No. 4,606,521 patented Aug. 19, 1986 to G. R. Williams on a "Cylinder Holder"; and U.S. Pat. No. 4,624,432 patented Nov. 25, 1986 to F. Salacuse and assigned to Super Glue Corporation on a "Heavy Duty Clamping System"; and U.S. Pat. No. 4,848,714 patented Jul. 18, 1989 to T. Ziaylek, Jr. et al on a "Mounting Plate With Rollers"; and U.S. Pat. No. 4,905,950 patented Mar. 6, 1990 to M. L. Turner et al and assigned to Convenience Marine Products, Inc. on a "Mounting Assembly"; and U.S. Pat. No. 5,025,935 patented Jun. 25, 1991 to J. L. Hadachek on a "Portable Upright Scuba Cylinder Retention Rack"; and U.S. Pat. No. 5,297,890 patented to A. D. Commins on Mar. 29, 1994 and assigned to Simpson Strong-Tie Company, Inc. on a "Wood-To-Pipe Connection"; and U.S. Pat. No. 5,318,266 patented Jun. 7, 1994 to H. L. Liu on a "Drink Holder"; and U.S. Pat. No. 5,354,029 patented Oct. 11, 1994 to T. Ziaylek, Jr. et al on a "Quick Release Tank Support Bracket With Positive Locking Engagement Means"; and U.S. Pat. No. 5,423,508 patented Jun. 13, 1995 to S. R.

Isenga et al and assigned to ITC, Incorporated on a "Foldable Support For Beverage Container"; and U.S. Pat. No. 5,440,098 patented Aug. 8, 1995 to T. A Matus and assigned to Miller Electric Manufacturing Co. on a "Gas Cylinder Lifting System"; and U.S. Pat. No. 5,533,701 patented Jul. 9, 1996 to R. D. Trank on a "Foldable Stabilizing Bracket For Compressed Air Tanks"; and U.S. Pat. No. 5,579,967 patented Dec. 3, 1996 to D. T. Berg on a "Mounting System For Securing Poly Tank To scuba Main Cylinders"; and U.S. Pat. No. 5,607,133 patented Mar. 4, 1997 to H. L. Markham et al and assigned to E-Z Metal Products, Inc. on an "Apparatus And Method For Supporting A Cylindrical Tank"; and U.S. Pat. No. 5,681,080 patented Oct. 28, 1997 to G. M. Pond et al and assigned to Seats, Inc. on a "Vehicle Seat For Person Wearing Self-Contained Breathing Apparatus"; and U.S. Pat. No. 5,833,195 patented Nov. 10, 1998 to D. H. Haynes and assigned to The United States of American as represented by the Secretary of the Army on a "Gas Retaining Device"; and U.S. Pat. No. 5,890,544 patented Apr. 6, 1999 to R. Love et al on a "Self-Contained Remote Automated Fire Suppression"; and U.S. Pat. No. 5,906,302 patented May 25, 1999 to M. J. Spergel on a "Scuba Tank Mounting Mechanism"; and U.S. Pat. No. 5,975,475 patented Nov. 2, 1999 to G. S. Chaplin on a "Fire Extinguisher Holder"; and U.S. Pat. No. 5,984,612 patented Nov. 16, 1999 to M. D. Tatro on a "Tank Lifting Device"; and U.S. Pat. No. 5,987,717 patented Nov. 23, 1999 to S. R. Peterson et al and assigned to Superior Flamefighter Corporation on a "Remote Release Latching Method And Device"; and U.S. Pat. No. 6,113,004 patented Sep. 5, 2000 to R. W. Steingass et al and assigned to Task Force Tips, Inc. on a "Portable Kit For Firefighters"; and U.S. Pat. No. 6,138,768 patented Oct. 31, 2000 to M. Fujiki and assigned to Masawu Fujiki; Shichifuku Co., Ltd. on a "Gas Type Fire Extinguisher"; and U.S. Pat. No. 6,168,130 patented Jan. 2, 2001 to K. Yokogi and assigned to L'Air Liquide Societe Anonyme pour I'Etude et l'Exploitation des Procedes Georges Claude on a "Cylinder Cabinet"; and U.S. Pat. No. 6,220,557 patented Apr. 24, 2001 to M. P. Ziaylek et al and assigned to Michael P. Ziaylek, Theodore Ziaylek, Jr. and Theodore P. Ziaylek on a "Mounting Bracket Means For Detachably Supporting A Generally Cylindrically-Shaped Member Upon A Wall Surface"; and U.S. Pat. No. 6,367,753 patented Apr. 9, 2002 to D. T. Berg on a "Pony Tank Quick Release"; and U.S. Pat. No. 6,655,745 patented Dec. 2, 2003 to J. A. Fohrenkamm et al and assigned to H.O. Bostrom Company, Inc. on an "Emergency Vehicle Seat With Integrated Seat Belt"; and U.S. Pat. No. 6,685,153 patented Feb. 3, 2004 to M. F. Foreman on a "Restraining System And Method"; and U.S. Pat. No. 6,702,242 patented Mar. 9, 2004 to T. Ziaylek, Jr. et al on a "Releasable Tank Holding Assembly Securable To A Hollow Seat Back To Facilitate Detachable Securement Of A Tank Thereinto"; and U.S. Pat. No. 6,769,659 patented Aug. 3, 2004 to G. A. Martello on a "Bottle Bracket"; and U.S. Pat. No. 6,772,982 patented Aug. 10, 2004 to N. Nakagawa et al and assigned to Mitsubishi Heavy Industries, Ltd. on a "Mounting Structure"; and U.S. Pat. No. 6,769,659 patented Aug. 3, 2004 to G. A. Martello on a "Bottle Bracket"; and U.S. Pat. No. 6,779,770 patented to K. Kaupp on Aug. 24, 2004 and assigned to Fischer Automotive Systems GmbH on a "Holder For A Beverage Container"; and U.S. Pat. No. 6,783,104 patented Aug. 31, 2004 to S. A. Roth on a "Deformable Clamp Employed To Stiffen Hanger Rod"; and U.S. Pat. No. 6,830,226 patented Dec. 14, 2004 to B. J. Field et al and assigned to Pacific Safety Products, Inc. on a "Quick Release Supporting Apparatus For A Canister"; and U.S. Pat. No. 6,863,198 patented Mar. 8, 2005 to R. W. Darby on a "Propane Tank Transport Device"; and U.S. Pat. No. 6,883,766 patented Apr. 26, 2005 to M. P. Ziaylek et al on a "Quick Release Mechanical Bracket"; and U.S. Pat. No. 6,889,947 patented May 10, 2005 to F. W. Alberts on a "Holder"; and U.S. Pat. No. 6,926,243 patented Aug. 9, 2005 to M. P. Ziaylek et al on a "Mounting Bracket With An Ejection Means For Detachable Retaining Of A Cylindrical Tank Member"; and U.S. Pat. No. 6,951,328 patented Oct. 4, 2005 to A. Drapeau et al on an "Adjustable Garbage Can Holder"; and U.S. Pat. No. 6,976,594 patented Dec. 20, 2005 to R. E. Young on a "Cylinder Holder For Impact Resistant Storage"; and U.S. Pat. No. 7,028,962 patented Apr. 18, 2006 to P. E. Hostetler on a "Portable Holder For Gas Cylinders"; and U.S. Pat. No. 7,063,298 patented Jun. 20, 2006 to D. Henry on a "Holder For Grease Gun"; and U.S. Pat. No. 7,070,372 patented Jul. 4, 2006 to R. L. Denike et al on a "Portable Cylinder Holder, Carrier And Securing System"; and U.S. Pat. No. 7,114,282 patented Oct. 3, 2006 to S. Nakagawa and assigned to Shimano Inc. on a "Rod Clamp"; and U.S. Pat. No. 7,114,690 patented Oct. 3, 2006 to D. R. Bissen and assigned to Schwing American, Inc. on a "Universal Mast Support Frame And Method For Mounting Masts"; and U.S. Design Pat. No. 188,000 patented May 24, 1960 to Jesse P. Shanok et al on a "Support For A Flashlight Or Similar Article"; and U.S. Design Pat. No. 222,527 patented Nov. 2, 1971 to Theodore Ziaylek, Jr. on a "Bracket For Use With Lifesaving Equipment"; and U.S. Design Pat. No. 237,357 patented Oct. 28, 1975 to Theodore Ziaylek, Jr. and assigned to Ziamatic Corporation on a "Tank Support Bracket For Lifesaving Equipment"; and U.S. Design Pat. No. 245,929 patented Sep. 27, 1977 to Roger Jay Montambo and assigned to The Ansul Company on a "Fire Extinguisher Bracket"; and U.S. Design Pat. No. 267,227 patented Dec. 14, 1982 to Theodore Ziaylek, Jr. and assigned to Ziamatic Corporation on a "Support Bracket For A Gas Cylinder"; and U.S. Design Pat. No. 275,264 patented Aug. 28, 1984 to Joseph B. Wegener, II and assigned to Above Water Mfg. on a "Mounting Bracket For Attaching A Sonar Transducer To A Boat Stern"; and U.S. Design Pat. No. 298,704 patented Nov. 29, 1988 to Theodore Ziaylek, Jr. on a "Seat For Use Primarily In Emergency Vehicles"; and U.S. Design Pat. No. 303,738 patented Oct. 3, 1989 to Theodore Ziaylek, Jr. on a "Rotatable Cylinder Holder"; and U.S. Design Pat. No. 314,325 patented Feb. 5, 1991 to Theodore Ziaylek, Jr. et al on a "Clamping Set Of Bracket Aims For Supporting Tubular Objects"; and U.S. Design Pat. No. 319,778 patented Sep. 10, 1991 to Theodore Ziaylek, Jr. on a "Vertical Support Brace Bracket Panel For Holding Tubular Objects"; and U.S. Design Pat. No. 347,735 patented Jun. 14, 1994 to Theodore Ziaylek, Jr. et al on a "Quick Release Support Tank Bracket"; and U.S. Design Pat. No. 394,381 patented May 19, 1998 to Theodore Ziaylek, Jr. et al on a "Tank Bracket"; and U.S. Design Pat. No. 424,414 patented May 9, 2000 to Michael P. Ziaylek et al and assigned to Michael P. Ziaylek, Theodore Ziaylek, Jr. and Theodore P. Ziaylek on an "Adjustable Mounting Bracket For A Cylindrical Member"; and U.S. Design Pat. No. 434,495 patented Nov. 28, 2000 to Lynn J. Whalen et al and assigned to Wheeled Coach Industries, Inc. on an "Oxygen Bottle Holder"; and U.S. Design Pat. No. 480,294 patented Oct. 7, 2003 to Theodore Ziaylek, Jr. et al on a "Releasable Tank Holding Assembly"; and U.S. Design Pat. No. 494,049 patented Aug. 10, 2004 to Michael P. Ziaylek, et al on a "Mounting Bracket With Ejection Mechanism For Holding A Cylindrical Tank"; and U.S. Design Pat. No. 494,453 patented Aug. 17, 2004 to Michael P. Ziaylek et al on a "Mechanical Locking Bracket For Holding Cylinders"; and U.S. Design Pat. No. 503,832 patented Apr. 5, 2005 to Add T. Kennon on a "Fire Extinguisher Housing And Stand"; and U.S. Design Pat. No. 522,180 patented May 30, 2006 to Pierre A. Goria, II on a "Fire Extinguisher Holder".

SUMMARY OF THE INVENTION

The present invention provides a positively engaging apparatus for releasably retaining of a cylindrical tank in an inverted vertical position which includes a backing plate extending generally vertically which preferably includes a foot plate retaining slot defined therewithin.

Also included in the apparatus of the present invention is an upper bracket securable with respect to the backing plate at a plurality of different locations to facilitate adjustment in the length of cylindrical tanks retained therewithin. The upper bracket includes a locking aperture preferably defined therein which extends therethrough. The upper bracket further includes a rear panel adjustably attachable to the backing plate along with a first side panel extending outwardly approximately perpendicularly from the rear panel and a second side panel extending outwardly approximately perpendicularly from the rear panel at a position disposed laterally from the position of the first side panel. In this manner the three panels can define therebetween a portion of the tank receiving zone for use with the present apparatus.

A foot plate is also included in the present invention mounted to the backing plate at a position below the upper bracket to further define a tank receiving zone thereabove which is adapted to receive a cylindrical tank stored therewithin vertically in inverted orientation. The tank receiving zone is defined adjacent the upper bracket means and above the foot plate and extends vertically along and adjacent the backing plate. Preferably the foot plate also includes a retaining cup facing upwardly toward the tank receiving zone to facilitate detachable securement of a cylindrical tank therein. Also preferably the foot plate is vertically adjustably securable to the backing plate by being adjustably securable within the foot plate retaining slot in order to allow adjustment to the length of the tank receiving zone as needed for use with tanks of various longitudinal dimensions. The foot plate also preferably includes an arcuate wall extending upwardly around the retaining cup to facilitate detachable securement of a cylindrical tank within the tank receiving zone.

The apparatus of the present invention further includes a top clamping member pivotally secured with respect to the first side panel and the second side panel and movable between a retracted position extending vertically along a rear panel of the upper bracket and a retaining position extending outwardly from the rear panel of the upper bracket for selectively retaining a cylindrical tank inverted within the tank receiving zone and engaged between the top clamping member thereabove and the foot plate therebelow. This top clamping member preferably includes a cam follower defined thereon. This cam follower preferably includes a protruding stud to facilitate engagement with a cam means. The foot plate further includes a retaining lip extending upwardly from the arcuate wall in order to further facilitate detachable securement of a cylindrical tank.

A locking mechanism is also provided which is attached to the upper bracket and is movable between a locked position in engagement with respect to the top clamping member for holding it in the retaining position and an unlocked position wherein it is disengaged from the top clamping member to facilitate return movement to the retracted position.

In more detail the locking mechanism preferably will include a cam pivotally movably attached with respect to the upper bracket mean and particularly and preferably with respect to the rear panel thereof. This cam is movable to a locked position into engagement with respect to the cam follower of the top clamping arm for selective rotating thereof in the retaining position. The cam is also movable between the locked position of the locking mechanism and the unlocked position thereof by pivoting in the direction extending approximately parallel to the back plate and preferably about a pivotal axis extending generally perpendicularly with respect to the backing plate to facilitate safe maintenance of engagement thereof. The cam preferably will also include a cam shoulder extending outwardly therefrom to facilitate maintaining of engagement between the cam follower and the cam responsive to the locking mechanism being positioned in the locked position. This cam extends beyond the cam follower into the locking aperture defined in the upper bracket for enhanced engagement between the cam and the cam follower responsive to the locking mechanism being positioned in the locked position to facilitate selective securement of the top clamping member in the retaining position.

The locking mechanism further includes a control arm secured to the cam and extending outwardly therefrom to facilitate control of movement of the cam of the locking mechanism between the locked position and the unlocked position. A positive locking means is also included preferably which also includes a locking link attached to the control arm which preferably comprises a locking rod member. A locking handle is also attached to the locking link and is operative responsive to movement thereof to urge the control arm of the locking mechanism toward the locked position thereof to assure the locking mechanism is positioned engaged in the fully locked position.

Furthermore the locking mechanism preferably includes flexible linkage including at least one detachable linkage member movably attached to a release and movably attached to the control arm to facilitate adjustability in the relative positioning therebetween. Further included in the locking mechanism can be a resilient cam biasing means such as a spring or the like attached to the cam and the upper bracket and operative to urge the cam of the locking means to pivotally move toward the locked position thereof.

A return biasing means is also included in the present invention which is attached to the top clamping member and to the upper bracket means for urging the top clamping member toward the retracted position thereof. In the preferred configuration the return biasing mechanism includes a first torsion spring attached to the first side panel of the upper bracket and the top clamping member for facilitating urging movement thereof toward the retracted position. Furthermore the return biasing means preferably will include a second torsion spring attached to the second side panel of the upper bracket means and the top clamping member for facilitating urging thereof toward the retracted position.

Further included is a releasing mechanism attached to the locking mechanism which is operative to urge the locking mechanism to move toward the unlocked position. This release means preferably includes a release lanyard attached with respect to the control arm which is operative to urge pivotal movement of the cam of the locking mechanism toward the unlocked position to facilitate movement of the top clamping member from the retaining position toward the retracted position facilitating release of a cylindrical tank from the tank receiving zone. In the preferred configuration of the present invention this release lanyard will extend generally parallel to the backing plate and the releasing means will include a lanyard guide extending through an angle of approximately 90 degrees with respect to the backing plate to re-direct the release lanyard to extend approximately perpendicular with respect to the backing plate. This orientation is to facilitate operation thereof. The lanyard guide preferably further includes a flexible guide tube defining a guide bore therethrough adapted to receive the lanyard extending therethrough and further comprising a guide housing adapted to receive the flexible guide tube extending therethrough while being curved through an angle of approximately 90 degrees to facilitate re-directing of the release lanyard extending therethrough to be oriented perpendicularly relative to the backing plate.

The apparatus of the present invention further includes a bumper member attached to the rear panel of the upper bracket which extends outwardly therefrom into abutment with a cylindrical tank positioned within the tank receiving zone to facilitate securement therewithin responsive to movement of the top clamping member to the retaining position. In the preferred configuration this bumper member includes a first leg member and a second leg member oriented approximately perpendicular with respect to one another. The bumper member is detachably securable to the rear panel of the upper bracket with one of the leg members extending outwardly approximately perpendicularly therefrom to facilitate abutment thereof with respect to the cylindrical bracket positioned within the tank receiving zone to facilitate holding thereof responsive to the top clamping member being in the retaining position. Preferably the second leg member will be longer than the first leg member such that the bumper member can be detachably secured to the rear panel of the upper bracket means with the first leg member extending outwardly approximately perpendicular with respect to the rear panel member of the upper bracket member for use when smaller cylindrical tanks are positioned within the tank receiving zone. Also, the bumper member is preferably detachably secured to the rear panel of the upper bracket member in a position with the second leg member extending outwardly approximately perpendicularly with respect to the rear panel of the upper bracket member for use with cylindrical tanks which are larger.

An intermediate bracket may also be included within the apparatus of the present invention which can be secured to the backing plate at a position below the upper bracket means and above the foot plate. The intermediate bracket is designed for the purpose of receiving the guide housing secured thereto for maintaining orientation thereof such as to orient the release lanyard to extend outwardly approximately perpendicular relative to the backing plate.

A foot plate adjustment means may be included which preferably includes a foot plate adjustment block mounted to the foot plate and extending outwardly therefrom to facilitate adjustment in the positioning thereof with respect to the backing plate. The foot plate adjustment mechanism further preferably includes a foot plate adjustment rod which is threaded and extends through the foot plate adjustment block and through the upper bracket. A foot plate adjustment handle is also preferably included secured to the foot plate adjustment rod at a position adjacent the upper bracket means. This foot plate adjustment rod is responsive to movement thereof to cause movement of the foot plate adjustment rod for changing the distance between the upper bracket and the foot plate to provide adjustment in the length of the tank receiving zone to facilitate usage thereof with cylindrical tanks of greatly varying sizes.

It is an object of the apparatus of the present invention to be usable with cylindrical tanks of various lengths and diameters.

It is an object of the apparatus of the present invention to releasably retain a cylindrical tank in an inverted vertical position.

It is an object of the apparatus of the present invention to allow for adjustability in the positioning and sizing of a cylindrical tank held therewithin.

It is an object of the apparatus of the present invention to mechanically firmly mount a cylindrical tank to prevent dislodgement thereof during all circumstances experienced by a vehicle within which the apparatus may be positioned.

It is an object of the apparatus of the present invention to have minimum maintenance requirements.

It is an object of the apparatus of the present invention to be of minimal capital financial costs.

It is an object of the apparatus of the present invention to accommodate all commonly used SCBA tanks and associated hardware.

It is an object of the apparatus of the present invention to allow for all adjustments to be made while the bracket is mounted in a seat to allow all adjustments to be made by a user positioned in front of the bracket.

It is an object of the apparatus of the present invention to provide accessibility to all adjustment mechanisms from the user's side of the bracket which facilitates quick and reliable releasing characteristics.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
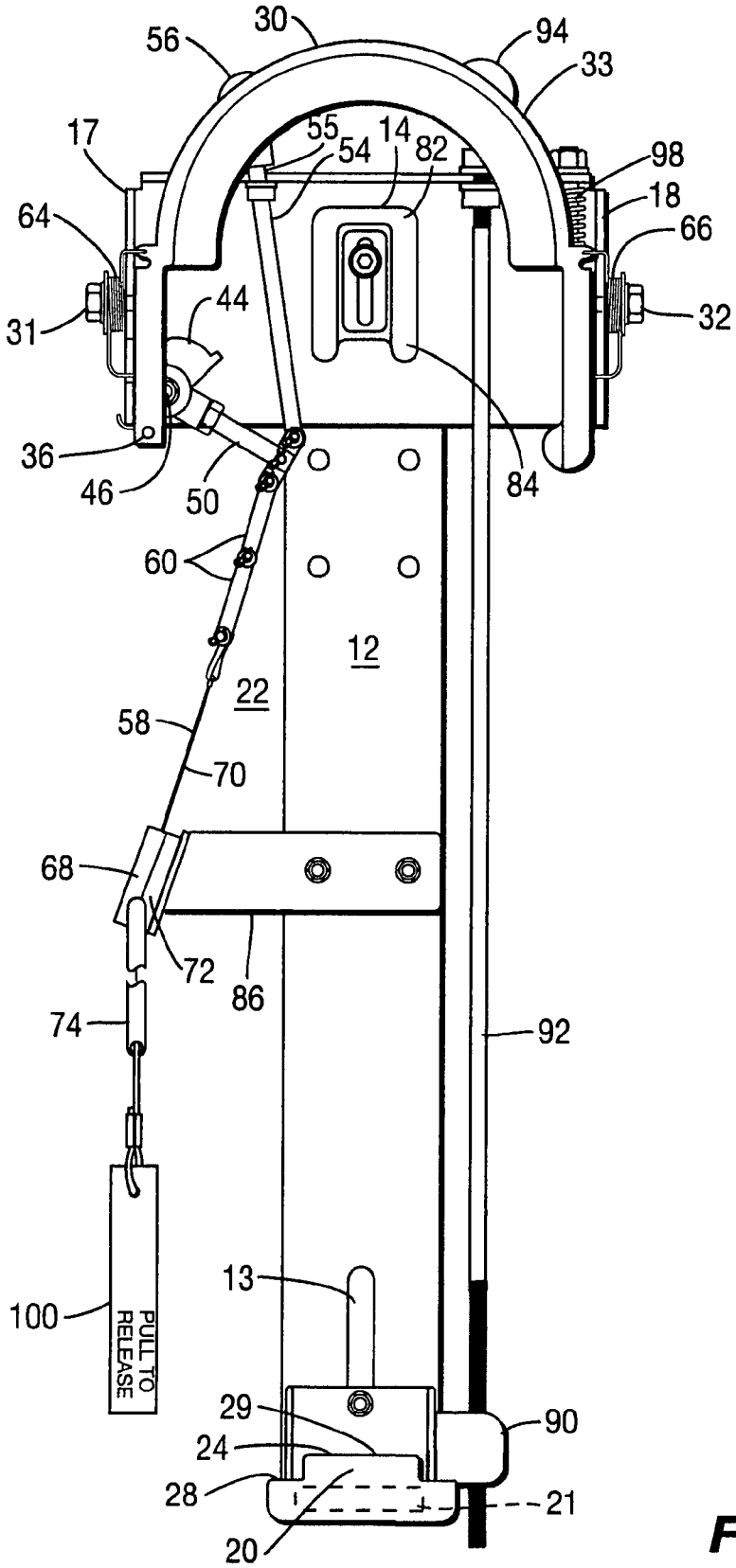
FIG. 1 is a front plan view of an embodiment of the positively engaging apparatus of the present invention for the purpose of releasably retaining of a cylindrical tank in an inverted vertical position shown in the unlocked retracted position.

The present invention provides a mounting apparatus for positively engaging and retaining of a cylindrical tank 10 in an inverted vertical position thereupon. The device allows for a simple means for locking of the tank with respect to the apparatus as well as a quick and reliable means for releasing of the tank from retention by the apparatus.

The apparatus includes a backing plate 12 which extends generally vertically and defines a plurality of mounting apertures therein to facilitate mounting thereof on any vertical environmental structure and is particularly adaptable mounted within the seatback of seats upon an emergency vehicle such as a fire truck. Often emergency personnel traveling on such vehicles require self-contained breathing apparatus to be attached to the rear portion of their torso and this apparatus provides a simple and expedient means for mounting and retaining of this apparatus in position ready to be donned by firefighters or other emergency personnel while traveling to a location requiring emergency assistance.

The backing plate 12 preferably is oriented extending generally vertically and will include an upper bracket 14 mounted thereto. The upper bracket includes a rear panel 16 preferably being directly attached to the backing plate 12 and a first side panel 17 and a second side panel 18 attached to the rear panel 16 and extending outwardly therefrom and spaced apart from one another. Preferably the area adjacent to the rear panel 16 and between the first side panel 17 and the second side panel 18 will define the upper portion of the tank receiving zone 22 of the present invention which is designed to receive a tank therein for selective retaining.

The apparatus further includes a foot plate 20 attached to the backing plate 12 at a location substantially below the upper bracket 14. Foot plate 20 is designed to support the top end of an inverted cylindrical tank 10 which is customarily smaller and provides a neck for attaching valves and similar devices and for this reason the foot plate 20 will preferably include a retaining cup 24 for holding such smaller area or valving configurations therewithin. Adjustment of the size of the retaining cup 24 can be provided by an adjustably positionable retaining block 21 defined within the foot plate 20. The retaining cup 24 is preferably formed by an upwardly extending arcuate wall 28 which further defines the retaining cup and facilitates retaining of the neck portion of the inverted cylindrical tank. A retaining lip 29 can be positioned at the outermost portion of the arcuate wall 28 and extending upwardly therefrom to facilitate retaining of the lower portion of the cylindrical tank 10 within the tank receiving zone 22 to in this manner prevent the lower portion of the tank from swinging outwardly.

Figure 2:
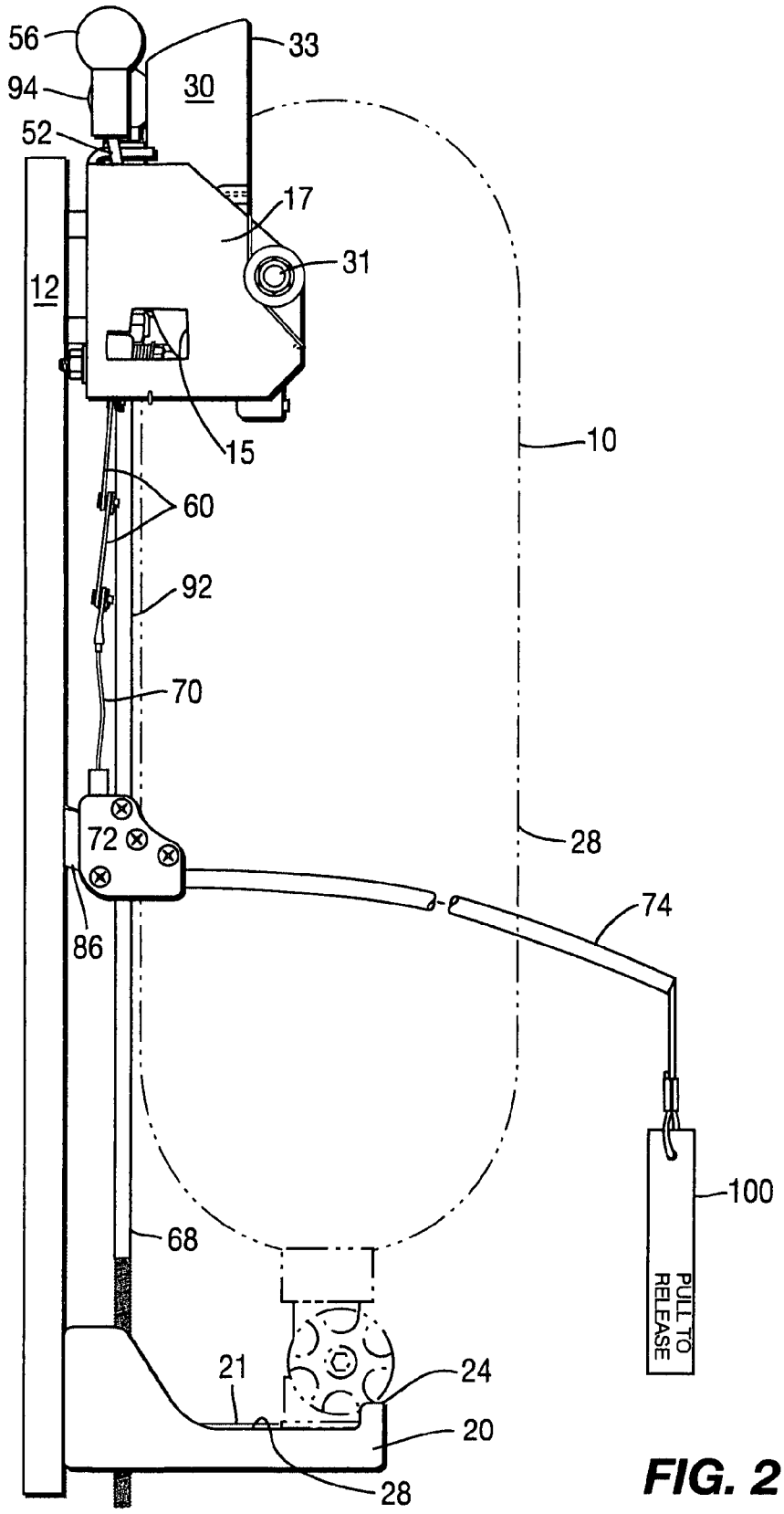
FIG. 2 is a side plan view of the embodiment shown in FIG. 1.

With this overall configuration it can be seen that the tank receiving zone 22 is defined above the foot plate 20 and runs vertically upwardly along the backing plate 12 to terminate at a position adjacent the upper bracket 14 and the rear panel 16 and between the first and second side panels 17 and 18. The approximate position of a tank positioned in this tank receiving zone is shown best in FIGS. 2 and 3. In FIG. 2 the tank is shown prior to engagement of the top clamping member 30 and in FIG. 3 it is shown after engagement of the top clamping member 30.

Top clamping member 30 is preferably pivotally movably secured with respect to the upper bracket 14 and preferably with respect to the first and second side panels 17 and 18. This mounting is achieved by the first pin means 31 extending into the first side panel 17 to facilitate pivotal movement of the top clamping member 30 with respect thereto. Similarly a second pin means 32 can extend into the second side panel 18 from the top clamping member 30 to facilitate pivotal movement of member 30 with respect to the second side panel 18.

Figure 3:
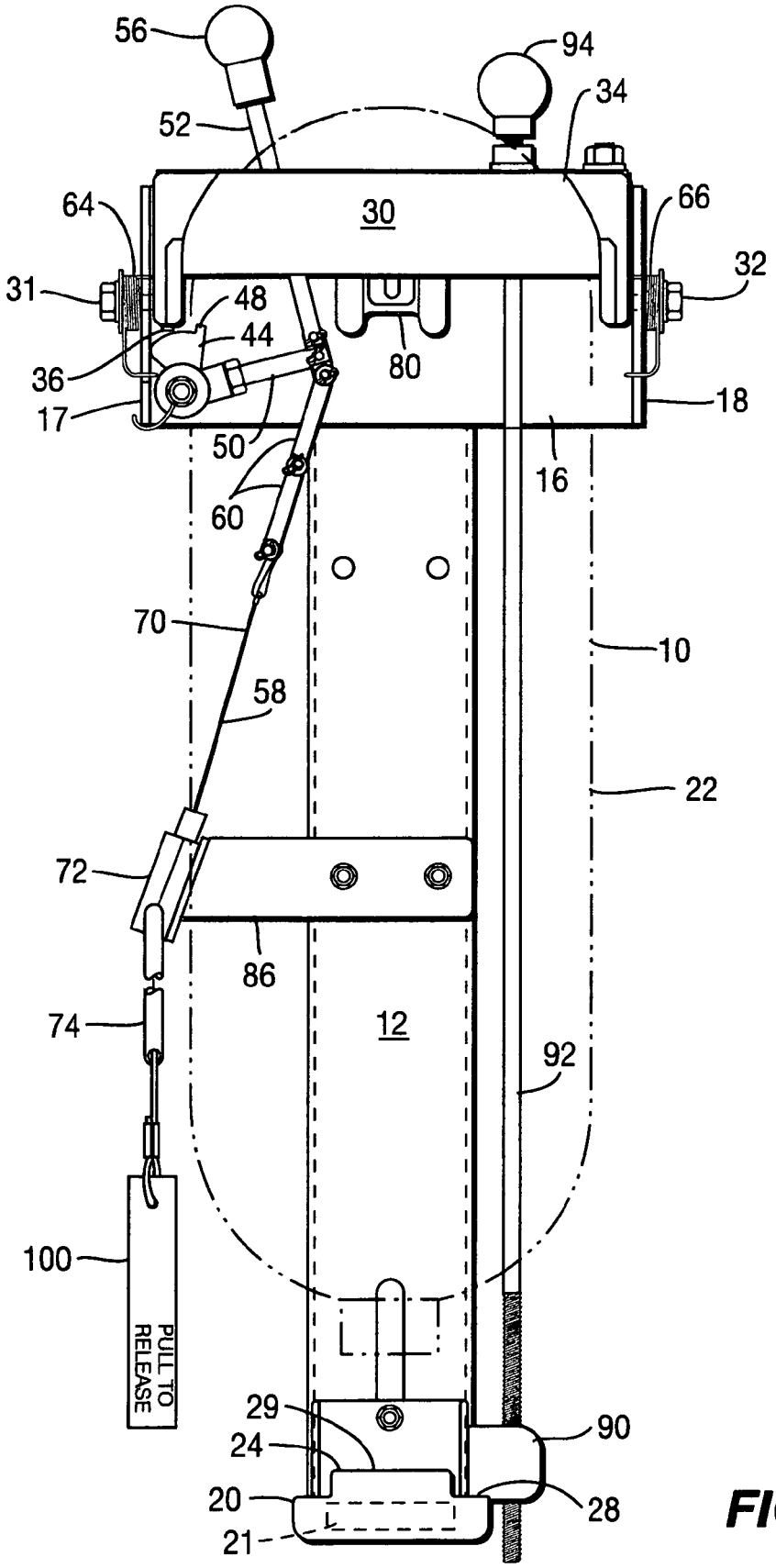
FIG. 3 is a front plan view of an embodiment of the positively engaging apparatus of the present invention for the purpose of releasably retaining of a cylindrical tank in an inverted vertical position shown in the locked retaining position.
Figure 4:
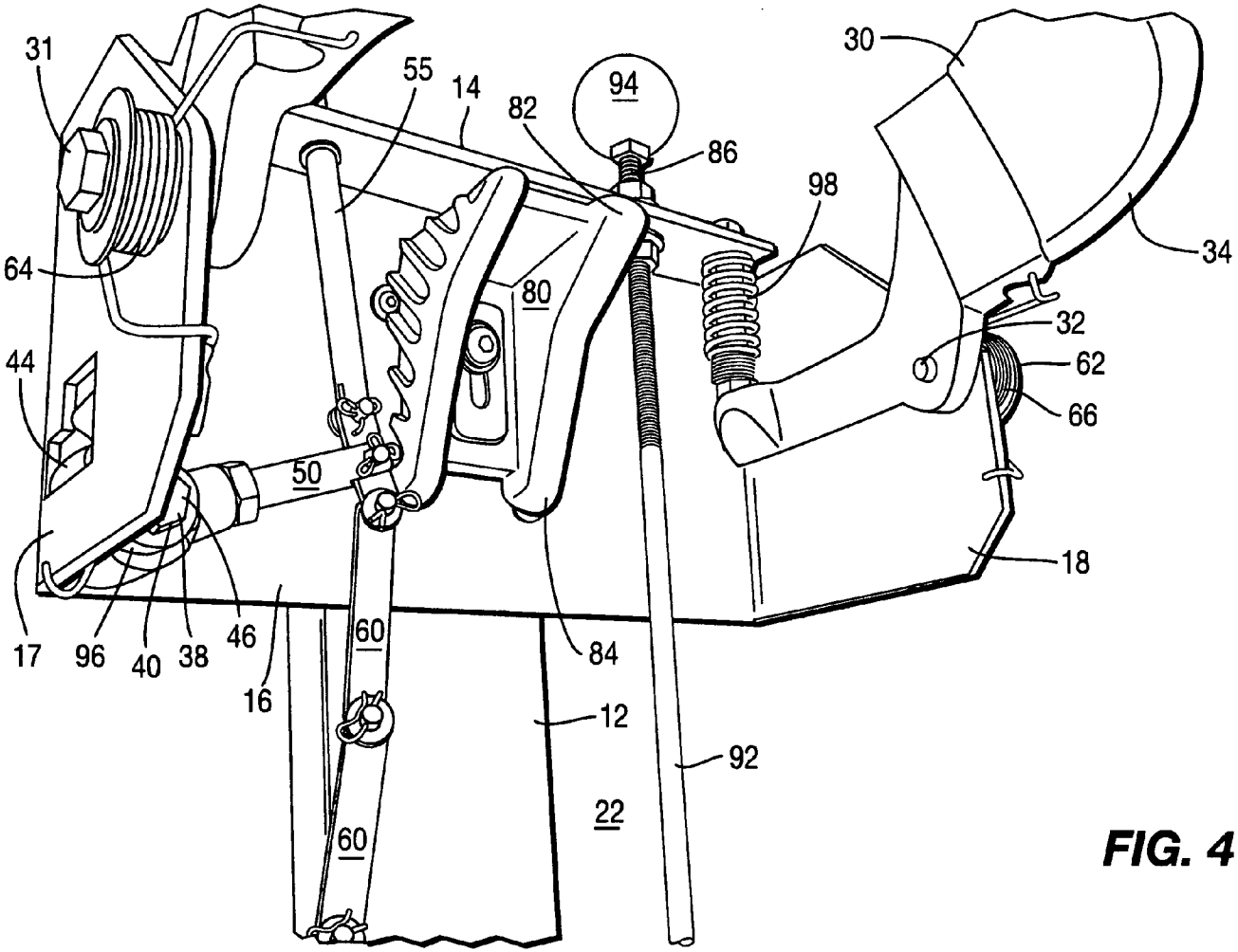
FIG. 4 is a perspective illustration showing the upper portion of an embodiment of the present invention more clearly illustrating the upper bracket area thereof.

In this manner the top clamping member 30 is movable between the retracted position 33 shown in FIG. 2 and the retaining position 34 shown in FIG. 3.

Figure 5:
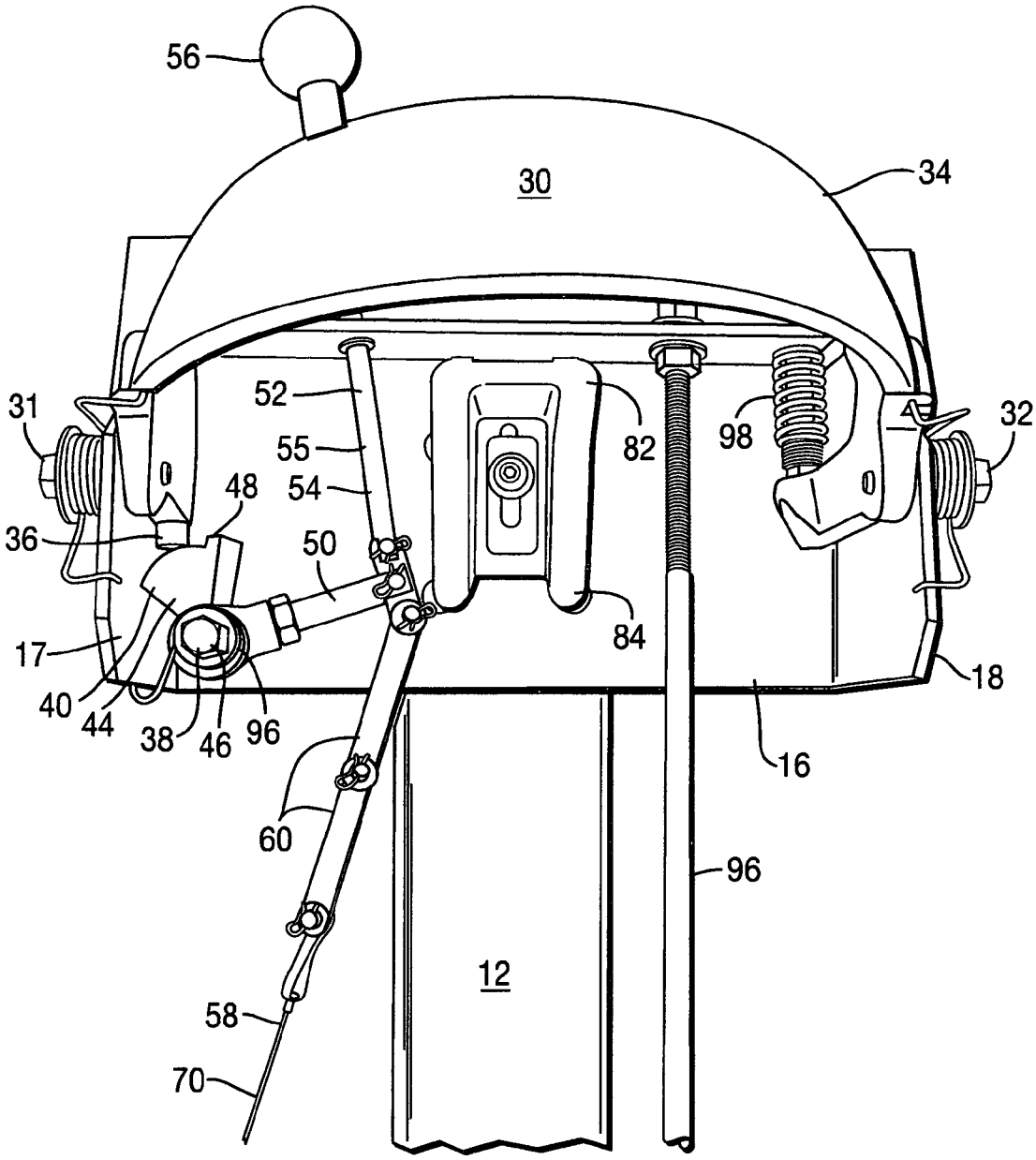
FIG. 5 is a front plan view of an embodiment of the upper bracket area of the embodiment of the invention shown in FIG. 3 positioned in the locked retaining position.
Figure 6:
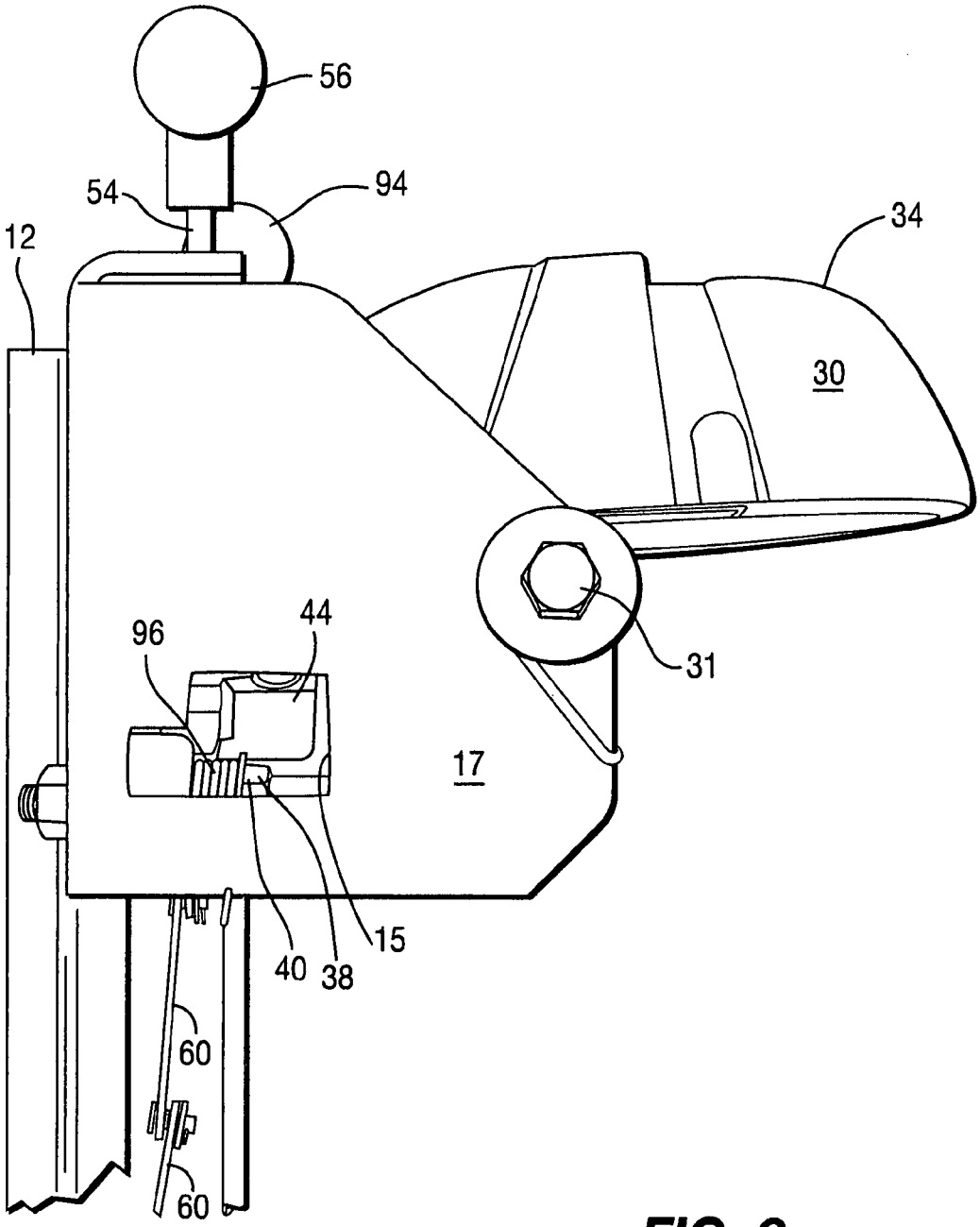
FIG. 6 is a side plan view of the embodiment shown in FIG. 1 as seen from the left.
Figure 7:
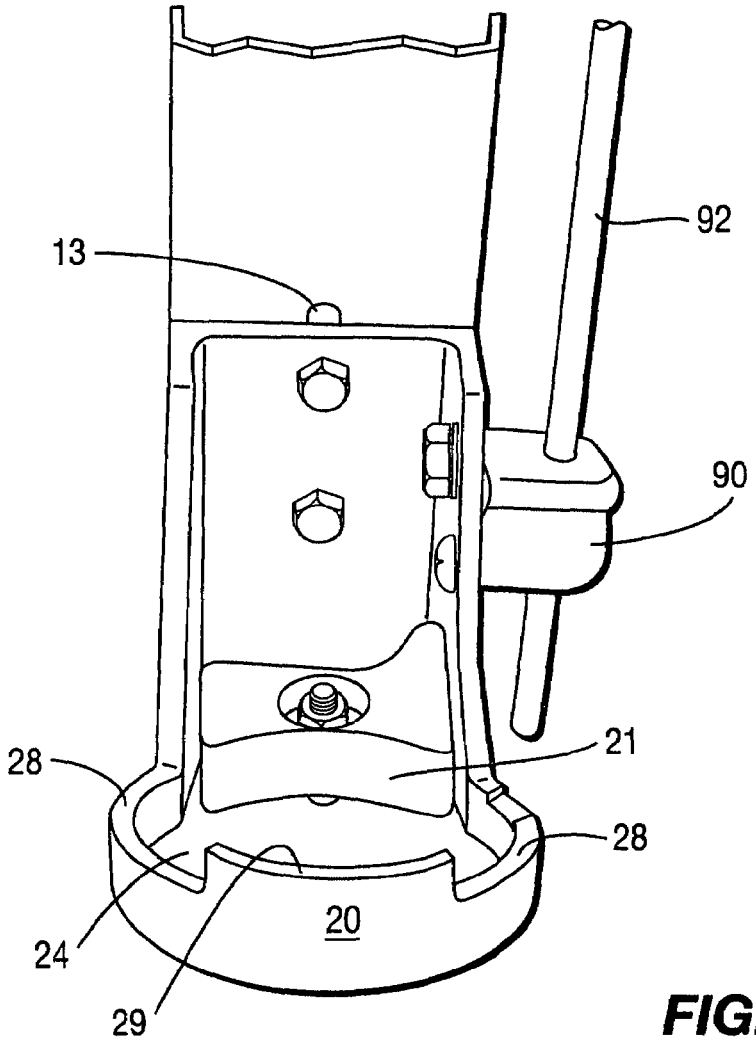
FIG. 7 is an enlarged view of the lower portion of the embodiment of this invention shown in FIG. 1 more clearly illustrating an embodiment of the foot plate.
Figure 8:
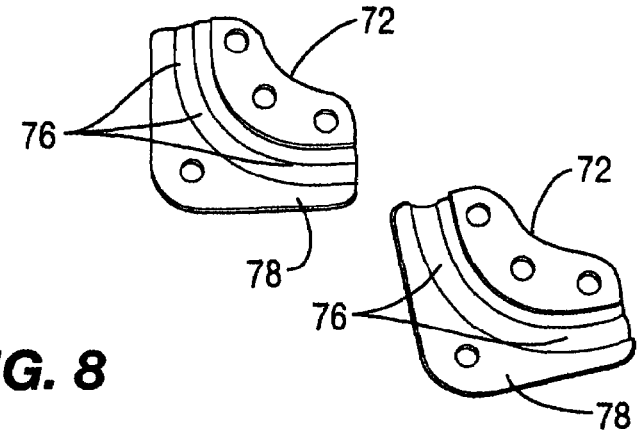
FIG. 8 is a view of an embodiment of the guide house of the present invention shown disassembled.

A locking mechanism 38 is included in the present invention which is movable between a locked position 40 and an unlocked position 42. The locking mechanism 38 includes a cam means 44 which is preferably pivotally mounted about a pivotal axis 46 with respect to the upper bracket 14. A cam follower means such as a protruding stud 36 is included with the top clamping member 30 and is adapted to be selectively movable into abutment with the cam 44 responsive to positioning of the pivotal movement of cam 44 between the locked and unlocked position and also responsive to movement of the top clamping member 30 between the retracted and retaining positions 33 and 34 thereof. Cam means 44 is pivotal as the locked mechanism 38 is moved toward the locked position 40 to be brought into abutment with the cam follower means or protruding stud 36 of top clamping member 30 to urge movement thereof to the retaining position 34 for holding of the cylindrical tank 10 within the tank receiving zone 22. When the locking mechanism 38 is moved to the unlocked position 42 the cam 44 will rotate clockwise as shown best in FIG. 5 thereby allowing return movement of the top clamping member 30 toward the retracted position 33 thereof. This return movement will be urged by the inclusion of return biasing means 62. Further, as shown in FIG. 5, the return biasing means can include a first torsion spring 64 mounted with respect to the top clamping member 30 and with respect to the first side panel 17 of the upper bracket 14 for the purpose of continuously urging movement of the top clamping member 30 toward the retracted position 33. In a similar manner a second torsion spring means 66 will be included operationally mounted between the top clamping member 30 and the second side panel 18 of the upper bracket 14 for the purpose of continuously urging movement of the top clamping member 30 toward the retracted position 33. Thus we can see that the steady state position of the top clamping member 30 is in the retracted position 33. However the top clamping member 30 when urged toward the retaining position 34 away from the retracted position 33 by manual manipulation thereof can be locked into the retaining position 34 by movement of the cam 44 into abutment with respect to the cam follower or protruding stud 36 of the top clamping member 30. The pressure exerted by the cam 44 on the cam follower 36 will further facilitate movement of the top clamping member 30 to the retaining position 34. Locking of the cam in this position will cause the top clamping member 30 to be locked in the retaining position 34.

The locking of the cam 44 into position in abutment with and urging pressure the protruding stud 36 can be achieved by operation of the positive locking means 52. A control arm 50 is mounted to the cam 44 and extends outwardly therefrom. The positive locking means 52 will include a locking link 54 extending from a locking handle 56 to the control arm 50. Thus the locking handle 56 will be connected to the control arm 50 through this locking link 54 which may be configured in the form of a locking rod member 55. Movement of the locking handle 56 upwardly as shown in FIGS. 3 and 5 will cause an upwardly directed movement to be imparted to the control arm 50. This will cause the cam to rotate in a counterclockwise direction thereby coming into abutment with respect to the cam follower or protruding stud 36 and thereby urging the top clamping member 30 to move toward the retaining position 34. It should be appreciated that movement of the cam 44 of the locking mechanism 38 to the fully locked position can sometimes be achieved by manual pressure being exerted downwardly onto the top clamping member 30 such that it moves firmly into abutment with respect to a cylindrical tank 10 positioned in the tank receiving zone 22.

However, if additional force is required, the operator can grasp the locking handle 56 and exert upper pressure thereon thereby pulling the locking link 54 upwardly and pulling the control arm 50 upwardly and imparting additional force which may be required in order to rotate the cam 44 in the counterclockwise direction to the fully locked position. A locking aperture 15 may be defined in the first side panel 17 of the upper bracket 14 to allow the cam 44 to extend to a significant distance beyond the protruding stud 36 and into the locking aperture 15 and perhaps through the locking aperture 15. This allows a firm securement to be created between the cam 44 and the cam follower 36 to facilitate securement of the locking mechanism 38 in the locked position 40. The extent of this movement however can be limited by the inclusion of a cam shoulder 48 defined on the cam 44. This shoulder is shown best in FIG. 5. This cam shoulder 48 is defined to come in contact with the protruding stud 36 to limit the extent of counterclockwise movement of the cam 44 to prevent undesirable movement beyond the fully locked position. In this manner the positive locking means 52 provided by the locking handle 56 and the locking rod 55 and the control arm 50 will provide the means for full engagement of the locking mechanism 38 without any over extended movement thereof.

Disengagement of the locking mechanism 38 can be achieved by operative movement of the flexible linkage 58 of the releasing means 68. Releasing means 68 includes a release lanyard 70 which is operatively connected through linkage 58 to the control arm 50 to cause movement thereof downwardly as shown best in FIG. 5 which movement would result in the disengagement of the cam 44 with respect to the cam follower or protruding stud 36 which allows the top clamping member 30 to be urged to move from the retaining position toward the retracted position 33 responsive to the pressure exerted by the return biasing means 62, in particular, the first and second torsion springs 64 and 66. The lanyard is a line formed of any material which could be steel or merely rope or some type of cord which is attached to the control arm 50 for causing movement thereof downwardly. This lanyard needs to be made readily accessible to a user and for this purpose a lanyard guide means 72 is included. This guide means includes a guide housing 78 defining a guide bore 76 extending therethrough. This guide bore passes causes the flexible guide tube 74 to be maintained in a 90 degree orientation to cause the downwardly extending movement of release lanyard 70 to be re-directed to an orientation approximately perpendicularly with respect to the backing plate 12 to be more easily capable of being grasped and used. As such, the user can grasp the release handle 100 and pull outwardly which will pull the lanyard 70 outwardly and pull the control arm 50 downwardly to disengage the locking mechanism 38 by force exerted thereon through the flexible linkage 58. Thereafter the cylindrical tank 10 can easily be removed from the tank receiving zone 22. Sometimes there is some frictional resistance to the initiation of movement of the top clamping member 30 from the retaining position 34 to the retracted position 33. This resistance to initial movement can be overcome by a movement initiation biasing means 98 as shown best in FIG. 5. This is a spring positioned between the upper bracket 14 and a portion of the top clamping member 30 and is compressed responsive to positioning of top clamping member 30 in the retaining position 34. Thus the initiation of movement from the retaining position 34 toward the retracted position 33 is initiated by releasing of this pre-compressed force of the movement initiation biasing means 98 immediately after unlocking of locking mechanism 38. This compression spring aids in initiating movement otherwise being urged by return biasing means 62.

When a cylindrical tank is positioned in the tank receiving zone 22 and the top clamping member 30 is in the retaining position 34 stability of the positioning of the cylindrical tank 10 is significantly enhanced by the inclusion of a bumper member 80. As shown best in FIG. 5, bumper member 80 will be in contact with rear portion and bottom surface of the inverted tank and will be brought into abutment thereof responsive to the tank being held in the tank receiving zone 22 by the top clamping member 30. Clamping member 30 will tend to compress the tank 10 slightly into abutment with respect to the bumper member 80 to facilitate retaining thereof in position. The bumper member 80 is preferably of a thermoplastic material to prevent damage to tank 10 and also preferably is detachably securable with respect to the upper bracket 14 and particularly with respect to the rear panel 16 thereof. The design of the bumper member 80 is important in that it should include two separate leg members oriented at approximately 90 degrees with respect to one another. The first leg member 82 will be somewhat shorter than the perpendicularly oriented second leg member 84. In this manner the bumper member 80 can be removed and repositioned with either the first or second leg member extending outwardly therefrom and the opposite non-chosen leg member extending parallel to the backing plate 12. In this manner the user will have a choice between two different dimensions of extension of the bumper member 18 from the backing plate outwardly. This will accommodate cylindrical tanks 10 of different sizes and increases the overall capability of usefulness and the universal customization characteristics of the apparatus of the present invention.

An intermediate bracket 86 may also be included in the present invention which is secured to the backing plate 12 at a position below the upper bracket 14 and above the foot plate 13. This bracket will be useful in providing a location to which the housing 78 of the lanyard guide 72 can be attached. By firm securement with respect to this intermediate bracket 86 the lanyard guide 72 can be maintained in the proper orientation to effectively convert the longitudinal direction of movement of the release lanyard 70 from a vertical orientation to a horizontal orientation approximately perpendicularly oriented with respect to the backing plate 12.

The configuration of the foot plate 20 of the present invention is a unique improvement. This foot plate will define a movable retaining block 21 for changing the size of the portion of the tank receiving zone 22 defined within the retaining cup 24 of the foot plate. Positioning of the foot plate can be adjustable to facilitate use of the apparatus of the present invention with tanks of various longitudinal lengths. In particular the upper bracket 14 can be made detachable with respect to the backing plate 12 such that it could be attached at various positions therealong to vary the total overall vertical distance between the upper bracket 14 and the foot plate 20. Another more fine version of adjustment can be made by a foot plate adjustment means 88. This foot plate adjustment means will include a foot plate retaining slot 13 defined in the backing plate 12 immediately adjacent to the location where the foot plate 20 is mounted. Preferably the foot plate will be mounted within the foot plate retaining slot 13 with a low function yet firm mounting apparatus. This will allow some limited vertical movement of the foot plate 20 vertically along the foot plate retaining slot 13 but will prevent any excessive movement between the backing plate 12 and the foot plate 20. The foot plate 20 will also preferably include a foot plate adjustment block 90. A foot plate adjustment handle 94 will preferably be mounted above the upper bracket 18 and a foot plate adjustment rod 92 will extend from the foot plate adjustment handle 94 downwardly into the foot plate adjustment block 90. Preferably the foot plate adjustment rod 92 will be threaded such that rotation of the foot plate adjustment handle 94 will cause the foot plate adjustment block 90 to exert pressure upon the body of the foot plate 20 causing vertical movement thereof upwardly or downwardly as may be desired. This apparatus is generally described as the foot plate fine adjustment means 88 and provides a more delicate or fine adjustment as compared to the gross adjustment capability wherein the upper bracket 14 can be attached to the backing plate 12 at various vertical positions therealong.

When the vertical length of the tank receiving zone 22 is changed the positioning of the lanyard can become problematical. The lanyard itself is somewhat difficult to remove and replace and therefore the present invention contemplates the usage of a flexible linkage 58 extending between the lanyard and the control arm 50. This flexible linkage 58 preferably will include at least one or more detachable linkage members 60 which can be removed or replaced as needed dependent upon the repositioning of the upper bracket 14 relative to the backing plate 12 or responsive to fine adjustment of the foot plate through the foot plate adjustment means 88. In either of these cases it may be necessary to insert or remove individual detachable linkage members 60 in order to maintain the lanyard in the same relative position thereof with respect to the lanyard guide tube 74. This additional flexibility allows for refinement in the relative positioning of the lanyard relative to the other portions of the releasing means 68.

An important aspect of the present invention is in the complementary movement between the cam 44 and the cam follower or protruding stud 36. It is preferable that the cam 44 be urged in movement toward engagement with respect to the protruding stud 36 to facilitate locking movement of the locking means to the locked position and retaining of the top clamping member 30 in the retaining position 34. For this purpose a resilient cam biasing means or cam spring 96 may be included as best shown in FIG. 5. This spring will exert a constant pressure on the cam 44 to urge it to move counterclockwise toward a position into engagement with respect to the protruding stud 36 of the top clamping member 30. Thus the steady state position of the cam 44 will be in the fully engaged position and therefore the steady state position of locking mechanism 38 will always be toward the locked position 40 unless this movement is overcome by operation of the releasing means 68.

One of the important aspects of the present invention is to provide an apparatus which can releasably retain many different sizes and shapes of cylindrical tanks having various different configurations and various different added apparatus attached thereto. The present invention provides this means of accommodating a wide range of different self-contained breathing apparatus designs with an apparatus that positively and firmly engages the tank relative to the bracket which is an important characteristic especially within a moving vehicle. Also it is important that all adjustment to this bracket be capable of being operated from a position in front of the bracket. That is, no access need be made to the rear portion of the bracket in order to facilitate these various means of adjustment. Also the handling of the tank must be firm and yet gentle in order to prevent damage to the epoxy resin coating often included with these tank configurations. The use of multiple retaining surfaces such as the thermoplastic bumper in combination with the top clamping member and the adjustably positionable foot plate all provide means for delicately yet firmly and positively engaging a tank within a tank receiving zone for holding thereof.

Another important aspect of the present invention is in the configuration of the locking mechanism. The movement of the cam 44 to achieve movement of the locking mechanism 38 to the locked position 40 is a movement which is oriented approximately parallel to the backing plate rather than perpendicular thereto. This is an important consideration when the apparatus of the present invention is used with seats in an emergency vehicle such as a fire truck. Most collisions incurred by such vehicles exert a forwardly or vertically directed force upon all components of the vehicle. If the movement of the locking mechanism of the cam were oriented in a forward and backward direction, then a collision could cause the release of the locking mechanism and release of the cylindrical tank from the tank receiving zone 22 responsive to such a collision. This release is obviously undesirable since it could cause additional damage to personnel or equipment within the vehicle. For this reason the back and forth movement of the locking mechanism 38 and particular the cam 44 is oriented lateral to the normal direction of movement of the vehicle rather than axially therewith. Thus, excessive force created by collisions with the vehicle will normally not cause a release of the locking mechanism 38 and thus the cylindrical tanks located within the emergency vehicle during such collisions will not be released when exposed to the forces of such a collision.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

We claim:

1. A positively engaging apparatus for releasably retaining of a cylindrical tank in an inverted vertical position comprising:

A. a backing plate extending generally vertically:

B. an upper bracket means defining a tank receiving zone thereadjacent, said upper bracket means including:

(1) a rear panel attached to said backing plate;

(2) a first side panel extending outwardly from said rear panel;

(3) a second side panel extending outwardly from said rear panel at a position spatially disposed from said first side panel to facilitate defining at least a portion of the tank receiving zone therebetween;

C. a foot plate mounted to said backing plate at a position below said upper bracket means to define a tank receiving zone thereabove adapted to receive a cylindrical tank stored therewithin inverted and vertically, said tank receiving zone being defined below said upper bracket means and above said foot plate and extending vertically along and adjacent said backing plate;

D. a top clamping member pivotally secured with respect to said first side panel and said second side panel and movable between a retracted position extending vertically along said rear panel of said upper bracket means and a retaining position extending outwardly from said rear panel of said upper bracket means for selectively retaining a cylindrical tank inverted within the tank receiving zone engaged between said top clamping member thereabove and said foot plate therebelow;

E. a locking mechanism attached to said upper bracket means and movable between an locked position in engagement with respect to said top clamping member for holding thereof in the retaining position and an unlocked position disengaged from said top clamping member to facilitate return movement thereof to the retracted position;

F. a return biasing means attached to said top clamping member and to said upper bracket means for urging said top clamping member toward the retracted position thereof;

G. a releasing means attached to said locking mechanism and operative to urge said locking mechanism to move toward the unlocked position; and H. a bumper member attached to said rear panel of said upper bracket means and extending outwardly therefrom into abutment with a cylindrical tank positioned within the tank receiving zone to facilitate securement therewithin responsive to movement of said top clamping member to the retaining position.

2. A positively engaging apparatus for releasably retaining of a cylindrical tank in an inverted vertical position as defined in claim 1 wherein said top clamping member includes a cam follower means defined thereon and wherein said locking mechanism includes a cam means pivotally movably attached with respect to said upper bracket means and movable to the locked position thereof into engagement with respect to said cam follower means of said top clamping arm for selective retaining thereof in the retaining position.

3. A positively engaging apparatus for releasably retaining of a cylindrical tank in an inverted vertical position as defined in claim 2 wherein said locking mechanism includes a control arm secured to said cam means and extending outwardly therefrom to facilitate control of movement of said cam means of said locking mechanism between the locked position and the unlocked position.

4. A positively engaging apparatus for releasably retaining of a cylindrical tank in an inverted vertical position as defined in claim 3 wherein said releasing means includes a release lanyard attached with respect to said control arm and being operative to urge pivotal movement of said cam means of said locking mechanism toward the unlocked position to facilitate movement of said top clamping member from the retaining position toward the retracted position facilitating release of a cylindrical tank from said tank receiving zone.

5. A positively engaging apparatus for releasably retaining of a cylindrical tank in an inverted vertical position as defined in claim 4 wherein said release lanyard extends generally parallel to said backing plate and wherein said releasing means includes a lanyard guide means extending through an angle of approximately ninety degrees with respect to said backing plate to redirect said release lanyard to extend approximately perpendicularly with respect to said backing plate to facilitate operation thereof.

6. A positively engaging apparatus for releasably retaining of a cylindrical tank in an inverted vertical position as defined in claim 5 wherein said lanyard guide means includes a flexible guide tube defining a guide bore means therethrough adapted to receive said lanyard means extending therethrough and further comprising a guide housing means adapted to receive said flexible guide tube extending therethrough while being curved through an angle of approximately ninety degrees to facilitate redirecting of said release lanyard extending therethrough to be oriented extending perpendicularly away from said backing plate.

7. A positively engaging apparatus for releasably retaining of a cylindrical tank in an inverted vertical position as defined in claim 6 further comprising an intermediate bracket means secured to said backing plate at a position below said upper bracket means and above said foot plate, said intermediate bracket means adapted to receive said guide housing means secured thereto to maintain orientation thereof such as to orient said release lanyard to extending outwardly approximately perpendicularly with respect to said backing plate.

8. A positively engaging apparatus for releasably retaining of a cylindrical tank in an inverted vertical position as defined in claim 4 wherein said locking mechanism includes a flexible linkage means including at least one detachable linkage member movably attached to said release lanyard and movably attached to said control arm to facilitate adjustability in the relative positioning therebetween.

9. A positively engaging apparatus for releasably retaining of a cylindrical tank in an inverted vertical position as defined in claim 3 wherein said locking mechanism further includes a positive locking means comprising:

A. a locking link attached to said control arm; and

B. a locking handle means attached to said locking link and being operative responsive to movement thereof to urge said control arm of said locking mechanism toward the locked position thereof to assure said locking mechanism is positioned engaged in the fully locked position thereof.

10. A positively engaging apparatus for releasably retaining of a cylindrical tank in an inverted vertical position as defined in claim 9 wherein said locking link comprises a locking rod member.

11. A positively engaging apparatus for releasably retaining of a cylindrical tank in an inverted vertical position as defined in claim 2 wherein said cam means includes a cam shoulder extending outwardly therefrom to facilitate maintaining of engagement between said cam follower means and said cam means responsive to said locking mechanism being positioned in the locked position.

12. A positively engaging apparatus for releasably retaining of a cylindrical tank in an inverted vertical position as defined in claim 2 wherein said upper bracket means defines a locking aperture means extending therethrough and wherein said cam means extends beyond said cam follower means into said locking aperture means for enhanced engagement between said cam means and said cam follower means responsive to said locking mechanism being positioned in the locked position to facilitate selective securement of said top clamping member in the retaining position.

13. A positively engaging apparatus for releasably retaining of a cylindrical tank in an inverted vertical position as defined in claim 2 wherein said locking means further includes a resilient cam biasing means attached to said cam means and to said upper bracket means and being operative to urge said cam means of said locking means to pivotally move toward said locked position thereof.

14. A positively engaging apparatus for releasably retaining of a cylindrical tank in an inverted vertical position as defined in claim 2 wherein said cam means of said locking mechanism is movable between the locked position thereof and the unlocked position thereof by pivoting in a direction extending approximately parallel to said back plate to facilitate safety in use thereof.

15. A positively engaging apparatus for releasably retaining of a cylindrical tank in an inverted vertical position as defined in claim 2 wherein said cam means of said locking mechanism is movable between the locked position thereof and the unlocked position thereof by pivotal movement about a pivotal axis extending generally perpendicularly with respect to said backing plate to facilitate safety in use thereof.

16. A positively engaging apparatus for releasably retaining of a cylindrical tank in an inverted vertical position as defined in claim 2 wherein said cam follower means of said top clamping member includes a protruding stud means made of material softer than said cam means to enhance durability thereof.

17. A positively engaging apparatus for releasably retaining of a cylindrical tank in an inverted vertical position as defined in claim 1 wherein said bumper member includes a first leg member and a second leg member, said bumper member being detachably attachable with respect to said rear panel of said upper bracket means with one of said leg members extending outwardly approximately perpendicularly therefrom to facilitate abutment thereof with respect to a cylindrical tank positioned within said tank receiving zone to facilitate holding thereof responsive to said top clamping member being in the retaining position.

18. A positively engaging apparatus for releasably retaining of a cylindrical tank in an inverted vertical position as defined in claim 17 wherein said bumper member is provided with said second leg member being longer than said first leg member such that said bumper member can be detachably secured to said rear panel of said upper bracket means with said first leg member extending outwardly approximately perpendicularly with respect to said rear panel of said upper bracket member for use when smaller cylindrical tank are positioned within said tank receiving zone and wherein said bumper member can be detachably secured to said rear panel of said upper bracket means with said second leg member extending outwardly approximately perpendicularly with respect to said rear panel of said upper bracket member for use when larger cylindrical tank are positioned within said tank receiving zone.

19. A positively engaging apparatus for releasably retaining of a cylindrical tank in an inverted vertical position as defined in claim 1 wherein said upper bracket means is securable with respect to said backing plate at a plurality of different locations to facilitate gross adjustment in the length of the tank receiving zone.

20. A positively engaging apparatus for releasably retaining of a cylindrical tank in an inverted vertical position as defined in claim 1 wherein said return biasing means comprises:

A. a first torsion spring means attached to said first side panel of said upper bracket means and said top clamping member for facilitating urging thereof toward the retracted position; and B. a second torsion spring means attached to said second side panel of said upper bracket means and said top clamping member for facilitating urging thereof toward the retracted position.

21. A positively engaging apparatus for releasably retaining of a cylindrical tank in an inverted vertical position as defined in claim 1 wherein said top clamping member is U-shaped and includes:

A. a first pin means extending through said first side panel of said upper bracket means to facilitate relative pivot movement therebetween; and B. a second pin means extending through said second side panel of said upper bracket means to facilitate relative pivot movement therebetween.

22. A positively engaging apparatus for releasably retaining of a cylindrical tank in an inverted vertical position as defined in claim 1 wherein said foot plate defines a retaining cup facing upwardly toward said tank receiving zone to facilitate detachably securement of a cylindrical tank therewithin.

23. A positively engaging apparatus for releasably retaining of a cylindrical tank in an inverted vertical position as defined in claim 22 wherein said foot plate includes an arcuate wall means extending upwardly around said retaining cup means to facilitate detachably securement of a cylindrical tank therewithin.

24. A positively engaging apparatus for releasably retaining of a cylindrical tank in an inverted vertical position as defined in claim 23 wherein said foot plate further includes a retaining lip extending upwardly from said arcuate wall to further facilitate detachably securement of a cylindrical tank therewithin.

25. A positively engaging apparatus for releasably retaining of a cylindrical tank in an inverted vertical position as defined in claim 22 wherein said foot plate includes retaining block which is adjustably positionable to facilitate firm securement within said retaining cup of a cylindrical tank positioned within the tank receiving zone.

26. A positively engaging apparatus for releasably retaining of a cylindrical tank in an inverted vertical position as defined in claim 1 wherein said backing plate defines a foot plate retaining slot means therewithin and wherein said foot plate is vertically adjustably securable therewithin to facilitate adjusting of the length of the tank receiving zone.

27. A positively engaging apparatus for releasably retaining of a cylindrical tank in an inverted vertical position as defined in claim 1 further comprising a foot plate adjustment means comprising:

A. a foot plate adjustment block mounted to said foot plate and extending outwardly therefrom to facilitate adjustment in the positioning thereof with respect to said backing plate;

B. a foot plate adjustment rod being threaded and extending through said foot plate adjustment block and through said upper bracket means; and C. a foot plate adjustment handle secured to said footplate adjustment rod at a position adjacent said upper bracket means, said foot plate adjustment handle being operative to movement thereof to cause movement of said foot plate adjustment rod for changing the distance between said upper bracket means and said foot plate to provide adjustment in the length of the tank receiving zone to facilitate usage thereof with cylindrical tanks of various sizes.

28. A positively engaging apparatus for releasably retaining of a cylindrical tank in an inverted vertical position as defined in claim 27 wherein said foot plate is attached with respect to said backing plate by frictional engagement therewith which allows relative vertical movable therebetween to facilitate operation of said foot plate adjustment means.

29. A positively engaging apparatus for releasably retaining of a cylindrical tank in an inverted vertical position as defined in claim 1 further comprising a movement initiation biasing means mounted on said upper bracket means and extending outwardly therefrom into abutment with said top clamping member and adapted to be resiliently biased by said top clamping member responsive to being in the retracted position thereof to facilitate the initiation of movement thereof toward the retaining position responsive to unlocking of said locking mechanism.

30. A positively engaging apparatus for releasably retaining of a cylindrical tank in an inverted vertical position comprising:

A. a backing plate extending generally vertically, said backing plate defining a foot plate retaining slot means therewithin:

B. an upper bracket means defining a tank receiving zone thereadjacent and therebelow, said upper bracket means including:

(1) a rear panel attached to said backing plate;

(2) a first side panel extending outwardly from said rear panel;

(3) a second side panel extending outwardly from said rear panel at a position spatially disposed from said first side panel;

C. a foot plate mounted to said backing plate at a position below said upper bracket means to define a tank receiving zone thereabove adapted to receive a cylindrical tank stored therewithin inverted and vertically, said tank receiving zone being defined below said upper bracket means and above said foot plate and extending vertically along and adjacent said backing plate, said foot plate defining a retaining cup facing upwardly toward said tank receiving zone to facilitate detachably securement of a cylindrical tank therewithin, said foot plate being vertically adjustably securable within said foot plate retaining slot means to facilitate adjusting of the length of the tank receiving zone;

D. a top clamping member pivotally secured with respect to said first side panel and said second side panel and movable between a retracted position extending vertically along said rear panel of said upper bracket means and a retaining position extending outwardly from said rear panel of said upper bracket means for selectively retaining a cylindrical tank inverted within the tank receiving zone engaged between said top clamping member thereabove and said foot plate therebelow, said top clamping member including a cam follower means defined thereon;

E. a locking mechanism attached to said upper bracket means and movable between an locked position in engagement with respect to said top clamping member for holding thereof in the retaining position and an unlocked position disengaged from said top clamping member to facilitate return movement thereof to the retracted position, said locking mechanism including:

(1) a cam means pivotally movably attached with respect to said rear panel of said upper bracket means and movable to the locked position thereof into engagement with respect to said cam follower means of said top clamping arm for selective retaining thereof in the retaining position, said cam means of said locking mechanism being movable between the locked position thereof and the unlocked position thereof by pivoting in a direction extending approximately parallel to said back plate and about a pivotal axis extending generally perpendicularly with respect to said backing plate to facilitate safety in use thereof;

(2) a control arm secured to said cam means and extending outwardly therefrom to facilitate control of movement of said cam means of said locking mechanism between the locked position and the unlocked position;

(3) a positive locking means comprising:

(a) a locking link attached to said control arm;

(b) a locking handle means attached to said locking link and being operative responsive to movement thereof to urge said control arm of said locking mechanism toward the locked position thereof to assure said locking mechanism is positioned engaged in the fully locked position thereof;

F. a return biasing means attached to said top clamping member and to said upper bracket means for urging said top clamping member toward the retracted position thereof, said return biasing means including:

(1) a first torsion spring means attached to said first side panel of said upper bracket means and said top clamping member for facilitating urging thereof toward the retracted position; and (2) a second torsion spring means attached to said second side panel of said upper bracket means and said top clamping member for facilitating urging thereof toward the retracted position;

G. a releasing means attached to said locking mechanism and operative to urge said locking mechanism to move toward the unlocked position, said releasing means including a release lanyard attached with respect to said control arm and being operative to urge pivotal movement of said cam means of said locking mechanism toward the unlocked position to facilitate movement of said top clamping member from the retaining position toward the retracted position facilitating release of a cylindrical tank from said tank receiving zone; and H. a bumper member attached to said rear panel of said upper bracket means and extending outwardly therefrom into abutment with a cylindrical tank positioned within the tank receiving zone to facilitate securement therewithin responsive to movement of said top clamping member to the retaining position.

31. A positively engaging apparatus for releasably retaining of a cylindrical tank in an inverted vertical position comprising:

A. a backing plate extending generally vertically, said backing plate defining a foot plate retaining slot means therewithin:

B. an upper bracket means securable with respect to said backing plate at a plurality of different locations to facilitate adjustment in the length of the cylindrical tanks retained, said upper bracket means defining a locking aperture means extending therethrough, said upper bracket means defining a tank receiving zone thereadjacent and therebelow, said upper bracket means including:

(1) a rear panel adjustably attachable to said backing plate;

(2) a first side panel extending outwardly from said rear panel;

(3) a second side panel extending outwardly from said rear panel at a position spatially disposed from said first side panel;

C. a foot plate mounted to said backing plate at a position below said upper bracket means to define said tank receiving zone thereabove adapted to receive a cylindrical tank stored therewithin inverted and vertically, said tank receiving zone being defined below said upper bracket means and above said foot plate and extending vertically along and adjacent said backing plate, said foot plate defining a retaining cup facing upwardly toward said tank receiving zone to facilitate detachable securement of a cylindrical tank therewithin, said foot plate being vertically adjustably securable within said foot plate retaining slot means to facilitate adjusting of the length of the tank receiving zone, said footplate including an arcuate wall means extending upwardly around said retaining cup means thereof to facilitate detachably securement of a cylindrical tank within said tank receiving zone;

D. a top clamping member pivotally secured with respect to said first side panel and said second side panel and movable between a retracted position extending vertically along said rear panel of said upper bracket means and a retaining position extending outwardly from said rear panel of said upper bracket means for selectively retaining a cylindrical tank inverted within the tank receiving zone engaged between said top clamping member thereabove and said foot plate therebelow, said top clamping member including a cam follower means defined thereon, said cam follower means of said top clamping member including a protruding stud means, said foot plate further including a retaining lip extending upwardly from said arcuate wall to further facilitate detachably securement of a cylindrical tank;

E. a locking mechanism attached to said upper bracket means and movable between an locked position in engagement with respect to said top clamping member for holding thereof in the retaining position and an unlocked position disengaged from said top clamping member to facilitate return movement thereof to the retracted position, said locking mechanism including:

(1) a cam means pivotally movably attached with respect to said rear panel of said upper bracket means and movable to the locked position thereof into engagement with respect to said cam follower means of said top clamping arm for selective retaining thereof in the retaining position, said cam means of said locking mechanism being movable between the locked position thereof and the unlocked position thereof by pivoting in a direction extending approximately parallel to said back plate and about a pivotal axis extending generally perpendicularly with respect to said backing plate to facilitate safety in use thereof, said cam means including a cam shoulder extending outwardly therefrom to facilitate maintaining of engagement between said cam follower means and said cam means responsive to said locking mechanism being positioned in the locked position, said cam means extending beyond said cam follower means into said locking aperture means defined in said upper bracket means for enhanced engagement between said cam means and said cam follower means responsive to said locking mechanism being positioned in the locked position to facilitate selective securement of said top clamping member in the retaining position;

(2) a control arm secured to said cam means and extending outwardly therefrom to facilitate control of movement of said cam means of said locking mechanism between the locked position and the unlocked position;

(3) a positive locking means comprising:

(a) a locking link attached to said control arm, said locking link comprising a locking rod member;

(b) a locking handle means attached to said locking link and being operative responsive to movement thereof to urge said control arm of said locking mechanism toward the locked position thereof to assure said locking mechanism is positioned engaged in the fully locked position thereof;

(4) a flexible linkage means including at least one detachable linkage member movably attached to a release and movably attached to said control arm to facilitate adjustability in the relative positioning therebetween;

(5) a resilient cam biasing means attached to said cam means and to said upper bracket means and being operative to urge said cam means of said locking means to pivotally move toward said locked position thereof;

F. a return biasing means attached to said top clamping member and to said upper bracket means for urging said top clamping member toward the retracted position thereof, said return biasing means including:

(1) a first torsion spring means attached to said first side panel of said upper bracket means and said top clamping member for facilitating urging thereof toward the retracted position; and (2) a second torsion spring means attached to said second side panel of said upper bracket means and said top clamping member for facilitating urging thereof toward the retracted position;

G. a releasing means attached to said locking mechanism and operative to urge said locking mechanism to move toward the unlocked position, said release means includes a release lanyard attached with respect to said control arm and being operative to urge pivotal movement of said cam means of said locking mechanism toward the unlocked position to facilitate movement of said top clamping member from the retaining position toward the retracted position facilitating release of a cylindrical tank from said tank receiving zone, said release lanyard extending generally parallel to said backing plate and said releasing means including a lanyard guide means extending through an angle of approximately ninety degrees with respect to said backing plate to redirect said release lanyard to extend approximately perpendicularly with respect to said backing plate to facilitate operation thereof, said lanyard guide means includes a flexible guide tube defining a guide bore means therethrough adapted to receive said lanyard means extending therethrough and further comprising a guide housing means adapted to receive said flexible guide tube extending therethrough while being curved through an angle of approximately ninety degrees to facilitate redirecting of said release lanyard extending therethrough to be oriented extending perpendicularly away from said backing plate;

H. a bumper member attached to said rear panel of said upper bracket means and extending outwardly therefrom into abutment with a cylindrical tank positioned within the tank receiving zone to facilitate securement therewithin responsive to movement of said top clamping member to the retaining position, said bumper member including:

(1) a first leg member;

(2) a second leg member with said bumper member being detachably attachable with respect to said rear panel of said upper bracket means with one of said leg members extending outwardly approximately perpendicularly therefrom to facilitate abutment thereof with respect to a cylindrical tank positioned within said tank receiving zone to facilitate holding thereof responsive to said top clamping member being in the retaining position, said second leg member being longer than said first leg member such that said bumper member can be detachably secured to said rear panel of said upper bracket means with said first leg member extending outwardly approximately perpendicularly with respect to said rear panel of said upper bracket member for use when smaller cylindrical tank are positioned within said tank receiving zone and wherein said bumper member can be detachably secured to said rear panel of said upper bracket means with said second leg member extending outwardly approximately perpendicularly with respect to said rear panel of said upper bracket member for use when larger cylindrical tank are positioned within said tank receiving zone;

I. an intermediate bracket means secured to said backing plate at a position below said upper bracket means and above said foot plate, said intermediate bracket means adapted to receive said guide housing means secured thereto to maintain orientation thereof such as to orient said release lanyard to extending outwardly approximately perpendicularly with respect to said backing plate; and J. a foot plate adjustment means comprising:

(1) a foot plate adjustment block mounted to said foot plate and extending outwardly therefrom to facilitate adjustment in the positioning thereof with respect to said backing plate;

(2) a foot plate adjustment rod being threaded and extending through said foot plate adjustment block and through said upper bracket means;

(3) a foot plate adjustment handle secured to said foot-plate adjustment rod at a position adjacent said upper bracket means, said foot plate adjustment handle being responsive to movement thereof to cause movement of said foot plate adjustment rod for changing the distance between said upper bracket means and said foot plate to provide adjustment in the length of the tank receiving zone to facilitate usage thereof with cylindrical tanks of various sizes.

* * * * *